US008985894B1

(12) United States Patent
Hunter

(10) Patent No.: US 8,985,894 B1
(45) Date of Patent: Mar. 24, 2015

(54) METHODS OF CONSTRUCTING A PUMP ISLAND PROTECTOR, AND A PUMP ISLAND PROTECTOR FORMED BY SUCH METHODS

(71) Applicant: Peter R. Hunter, Alpena, MI (US)

(72) Inventor: Peter R. Hunter, Alpena, MI (US)

( * ) Notice: Subject to any disclaimer, the term of this patent is extended or adjusted under 35 U.S.C. 154(b) by 76 days.

(21) Appl. No.: 14/019,578

(22) Filed: Sep. 6, 2013

(51) Int. Cl.
*E01F 1/00* (2006.01)
*E01C 11/22* (2006.01)

(52) U.S. Cl.
CPC *E01F 1/00* (2013.01); *E01C 11/221* (2013.01)
USPC ..... 404/72; 404/7; 404/8; 404/75

(58) Field of Classification Search
CPC ..... E01C 11/22; E01F 1/00
USPC ..... 404/7, 8, 71, 72, 75
See application file for complete search history.

(56) References Cited

U.S. PATENT DOCUMENTS

| | | | | |
|---|---|---|---|---|
| 2,294,855 | A * | 9/1942 | Thomason | 248/544 |
| 2,298,378 | A * | 10/1942 | Hodges | 362/152 |
| 6,409,422 | B1 * | 6/2002 | Mittermaier et al. | 404/8 |
| 6,712,546 | B1 * | 3/2004 | Radu et al. | 404/8 |
| 6,939,078 | B1 * | 9/2005 | Anderson et al. | 404/73 |
| 7,950,872 | B2 * | 5/2011 | Radu, Jr. | 404/7 |

* cited by examiner

*Primary Examiner* — Raymond W Addie
(74) *Attorney, Agent, or Firm* — Weiner & Burt, P.C.; Irvine M. Weiner; Pamela S. Burt

(57) ABSTRACT

A method of constructing a pump island protector to alleviate continuous maintenance required for a deteriorating existing steel pump island base, and a pump island protector constructed by the method. Using an adjustable form system and the combination of stainless steel members and new concrete, the existing pump island is re-wrapped with the stainless steel member and the new concrete.

20 Claims, 3 Drawing Sheets

METHODS OF CONSTRUCTING A PUMP ISLAND PROTECTOR, AND A PUMP ISLAND PROTECTOR FORMED BY SUCH METHODS

BACKGROUND OF THE INVENTION

The present invention relates generally to a method of constructing a pump island protector to alleviate continuous maintenance required for a deteriorating existing steel pump island base, and a pump island protector constructed by such a method.

More particularly, the present invention relates to a method of constructing a pump island protector to alleviate continuous maintenance required for a deteriorating existing steel pump island base and higher portions disposed on the base, and to a pump island protector constructed be such method.

It is a desideratum of the present invention to avoid the animadversions of conventional techniques for dealing with deterioration of existing pump island bases and/or higher portions disposed on such bases.

BRIEF SUMMARY OF THE INVENTION

The present invention provides a method of constructing a pump island protector to alleviate continuous maintenance required for a deteriorating existing steel pump island base, comprising the steps of: bending an existing steel perimeter form of the existing steel pump island base to a 90-degree angle for use as an anchoring point from the existing pump island base to new concrete and to create a clean edge; forming a cut in the perimeter of the existing island to a predetermined depth for accepting in said cut a stainless steel member to be dropped into said cut; positioning an adjustable form system a predetermined distance away from the existing pump island base; cutting and bending said stainless steel member to line the adjustable form system; pouring ready mix concrete into the adjustable form system flush with the top surface of the existing pump island base and finishing the concrete; and removing the adjustable form system to provide the completed pump island protector.

The present invention also provides a method of constructing a pump island protector to alleviate continuous maintenance required for a deteriorating existing steel pump island base and higher portions disposed on the base, comprising the steps of: bending an existing steel perimeter form of the existing steel pump island base to a 90-degree angle for use as an anchoring point from the existing pump island base to new concrete and to create a clean edge; forming a first cut in the perimeter of the existing island to a predetermined depth for accepting in said cut a stainless steel member to be dropped into said cut; positioning an adjustable form system a predetermined distance away from the existing pump island base; cutting and bending said stainless steel member to line the adjustable form system; pouring ready mix concrete into the adjustable form system flush with the top surface of the existing pump island base and finishing the concrete; removing the adjustable form system; bending an existing steel perimeter form of at least one of the higher portions disposed on the base to a 90-degree angle for use as an anchoring point from the existing higher portion to new concrete and to create a clean edge; forming a second cut in the perimeter of the existing higher portion to a predetermined depth for accepting in said second cut a second stainless steel member to be dropped into said second cut; positioning a second adjustable form system a predetermined distance away from the existing higher portion; cutting and bending said second stainless steel member to line said second adjustable form system; pouring ready mix concrete into said second adjustable form system flush with the top surface of the existing higher portion and finishing the concrete; and removing said second adjustable form system to provide the completed pump island protector.

The present invention also provides a pump island protector constructed in according to any of the aforementioned methods.

An object of the present invention is to provide a method as described hereinabove wherein the cut is formed by saw cutting.

Another object of the present invention is to provide a method as described hereinabove wherein the stainless steel member is a 20-gauge stainless steel member to line the adjustable form system.

Another object of the present invention is to provide a method as described hereinabove wherein the forming step forms a cut in the perimeter of the existing island to a predetermined depth of approximately an inch and a half for accepting in the cut the stainless steel member to be dropped into the cut.

Another object of the present invention is to provide a method as described hereinabove wherein the positioning step positions the adjustable form system a predetermined distance of approximately four inches away from the existing pump island base.

Another object of the present invention is to provide a method as described hereinabove which uses a form system that follows all contours of existing concrete around the pump island.

Another object of the present invention is to provide a method as described hereinabove which uses an adjustable form system and acombination of stainless steel and concrete.

Another object of the present invention is to provide a method as described hereinabove wherein the existing pump bases and/or higher portions mounted on the pump base are re-wrapped with stainless steel and filled with concrete to alleviate/avoid yearly maintenance and deterioration of the existing (non-stainless) steel wrapped pump island.

Another object of the present invention is to provide a pump island protector produced according to any of the methods described hereinabove.

Other objects, advantages, features and modifications of the present invention will become more apparent to those persons skilled in this particular area of technology and to other persons after having been exposed to the present patent specification with its accompanying drawings.

DETAILED DESCRIPTION OF THE INVENTION

Figure 1:
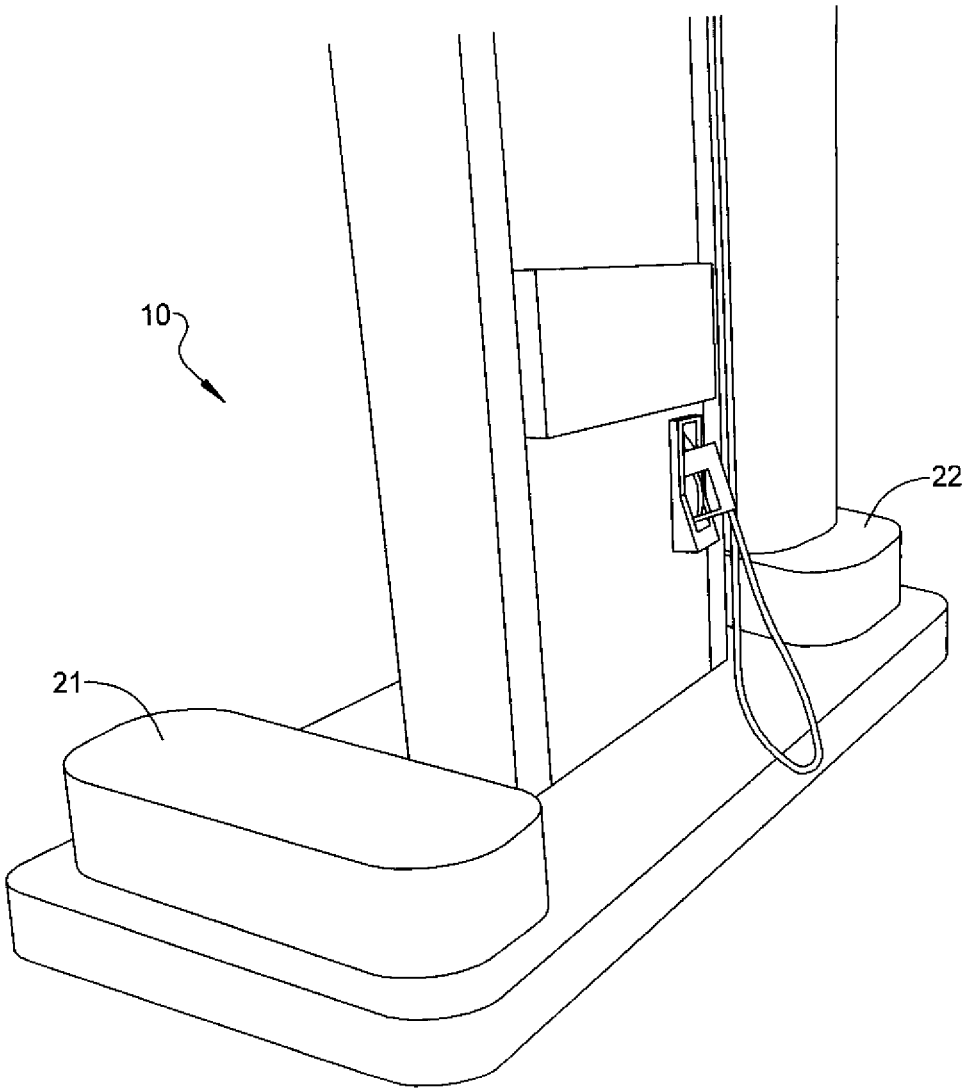
FIG. 1 shows a perspective view of a pump island protector according to the invention.

With reference to FIG. 1, there is shown a pump island protector 10 according to the invention.

FIGS. 2 through 7 illustrate the method by which the pump island protector 10 is constructed.

Figure 2:
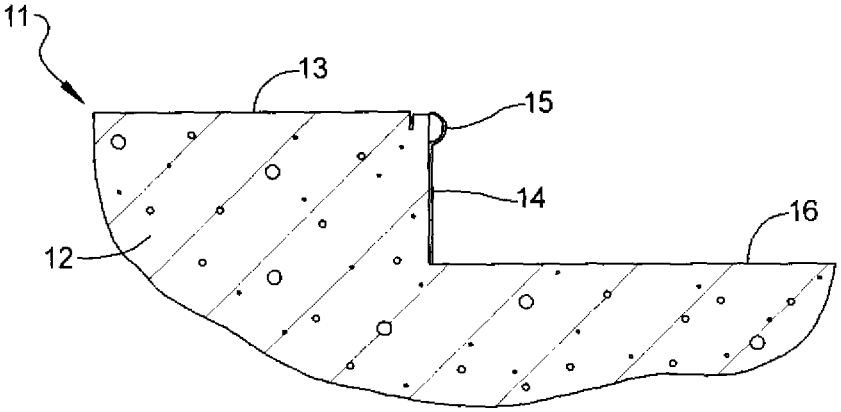
FIG. 2 shows a section of an existing pump island.

FIG. 2 shows the existing concrete island base 11, the existing concrete 12, the existing top surface 13 of the concrete 12, the existing steel retainer or form 14 with a bull nose 15, and the existing concrete drive 16.

Figure 3:
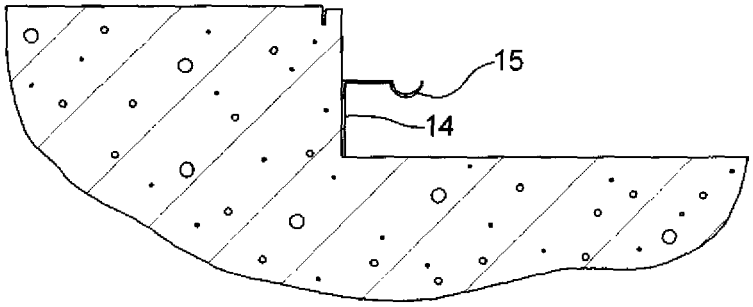
FIG. 3 shows the section of FIG. 2 with the existing steel bent to 90 degrees according to the invention

FIG. 3 illustrates how the existing steel retainer 14 is bent to 90 degrees.

Figure 4:
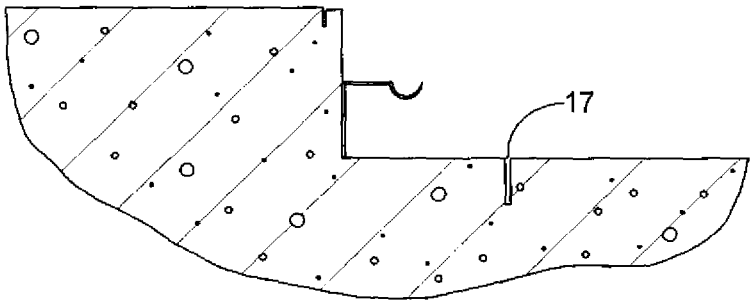
FIG. 4 shows the section of FIG. 3 with a saw cut in the existing concrete to accept a stainless steel member according to the invention.

FIG. 4 illustrates saw cutting the existing concree drive 16 to form a cut 17 for accepting a stainless steel member 18.

The stainless steel member 18 is 20-gauge stainless steel.

Figure 5:
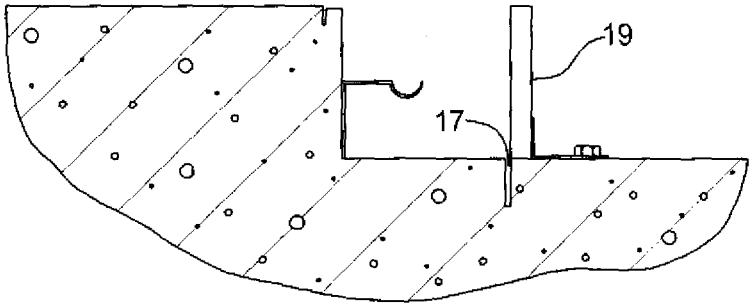
FIG. 5 shows the section of FIG. 4 with the set up adjustable form system around the perimeter according to the invention.

FIG. 5 illustrates an adjustable form system 19 set up around the perimeter of the existing concrete island base 11.

The adustable form system 19 follows all contours of the existing concrete 12.

Using the adjustable form system 19 and the combination of the stainless steel member 18 and new concrete 20, the existing pump island base 11 is re-wrapped with the stainless steel member 18 and the new concrete 20.

Figure 6:
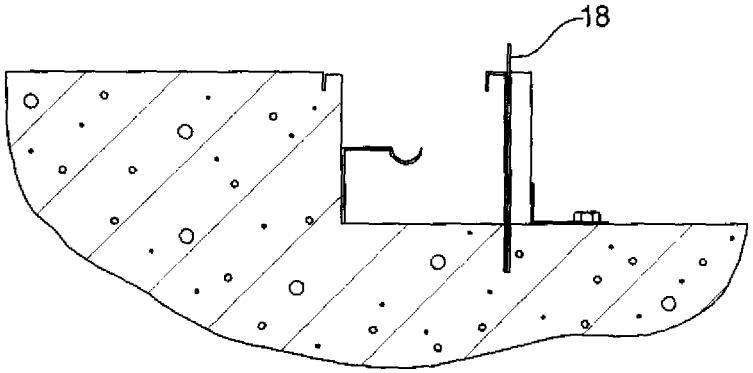
FIG. 6 shows the section of FIG. 5 with the form system lined with 20-gauge stainless steel according to the invention.
Figure 7:
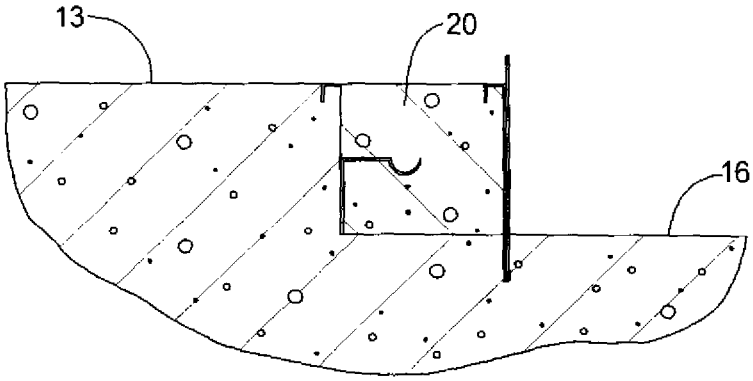
FIG. 7 shows the section of FIG. 6 with new concrete poured and finished flush with the existing concrete according to the invention.

FIG. 6 illustrates new concrete 20 which is poured in and finished flush to the existing top surface 13 of the existing concrete 12.

The completed pump island protector 10 is approximately 4½ inches larger than the existing island all the way around.

One of the methods of constructing the pump island protector 10 to alleviate continuous maintenance required for a deteriorating existing steel pump island base 11, comprises the steps of:

bending an existing steel perimeter form 14 of the existing steel pump island base 11 to a 90-degree angle for use as an anchoring point from the existing pump island base 11 to new concrete 20 and to create a clean edge;

forming the cut 17 in the perimeter of the existing island 11 to a predetermined depth for accepting in the cut 17 a stainless steel member 18 to be dropped into the cut 17;

positioning the adjustable form system 19 a predetermined distance away from the existing pump island base 11;

cutting and bending the stainless steel member 18 to line the adjustable form system 19;

pouring ready mix concrete 20 into the adjustable form system 19 flush with the top surface 13 of the existing pump island base 11 and finishing the concrete 20; and removing the adjustable form system 19 to provide the completed pump island protector 10.

Another one of the methods of constructing the pump island protector 10 to alleviate continuous maintenance required for a deteriorating existing steel pump island base 11 and higher portions 21 and 22 disposed on the existing steel island base 11, comprises the steps of:

bending an existing steel perimeter form 14 of the existing steel pump island base 11 to a 90-degree angle for use as an anchoring point from the existing pump island base 11 to new concrete 20 and to create a clean edge;

forming the cut 17 in the perimeter of the existing island 11 to a predetermined depth for accepting in the cut 17 a stainless steel member 18 to be dropped into the cut 17;

positioning the adjustable form system 19 a predetermined distance away from the existing pump island base 11;

cutting and bending the stainless steel member 18 to line the adjustable form system 19;

pouring ready mix concrete 20 into the adjustable form system 19 flush with the top surface 13 of the existing pump island base 11 and finishing the concrete 20; and removing the adjustable form system 19 from the pump island base;

bending an existing steel perimeter form of at least one of the higher portions 21 and 22 disposed on the base 11 to a 90-degree angle for use as an anchoring point from the existing higher portion 21 or 22 to new concrete and to create a clean edge;

forming a second cut 17 in the perimeter of the existing higher portion 21 or 22 to a predetermined depth for accepting in the second cut 17 a second stainless steel member 18 to be dropped into the second cut 17;

positioning a second adjustable form system 19 a predetermined distance away from the existing higher portion 21 or 22;

cutting and bending the second stainless steel member 18 to line the second adjustable form system 19;

pouring ready mix concrete into the second adjustable form system 19 flush with the top surface of the existing higher portion 21 and 22 and finishing the concrete; and removing the second adjustable form system 19 to provide the completed pump island protector 10.

While the foregoing describes only exemplary embodiments of the present invention, it is to be understood that the present invention covers all variations, modifications and changes thereof which will occur to those persons skilled in the art and to other persons after having been exposed to the present patent application.

The invention claimed is:

1. A method of constructing a pump island protector to alleviate continuous maintenance required for a deteriorating existing steel pump island base, comprising the steps of:

bending an existing steel perimeter form of the existing steel pump island base to a 90-degree angle for use as an anchoring point from the existing pump island base to new concrete and to create a clean edge;

forming a cut in the perimeter of the existing island to a predetermined depth for accepting in said cut a stainless steel member to be dropped into said cut;

positioning an adjustable form system a predetermined distance away from the existing pump island base;

cutting and bending said stainless steel member to line the adjustable form system;

pouring ready mix concrete into the adjustable form system flush with the top surface of the existing pump island base and finishing the concrete; and removing the adjustable form system to provide the completed pump island protector.

2. The method according to claim 1, wherein:

said cut is formed by saw cutting.

3. The method according to claim 1, wherein:

said stainless steel member is a 20-gauge stainless steel member to line said adjustable form system.

4. The method according to claim 2, wherein:

said stainless steel member is a 20-gauge stainless steel member to line said adjustable form system.

5. The method according to claim 1, wherein:

said forming step forms a cut in the perimeter of the existing island to a predetermined depth of approximately an inch and a half for accepting in said cut said stainless steel member to be dropped into said cut.

6. The method according to claim 2, wherein:

said forming step forms a cut in the perimeter of the existing island to a predetermined depth of approximately an inch and a half for accepting in said cut said stainless steel member to be dropped into said cut.

7. The method according to claim 3, wherein:

said forming step forms a cut in the perimeter of the existing island to a predetermined depth of approximately an inch and a half for accepting in said cut said stainless steel member to be dropped into said cut.

8. The method according to claim 4, wherein:

said forming step forms a cut in the perimeter of the existing island to a predetermined depth of approximately an inch and a half for accepting in said cut said stainless steel member to be dropped into said cut.

9. The method according to claim 1, wherein:

said positioning step positions said adjustable form system a predetermined distance of approximately four inches away from the existing pump island base.

10. The method according to claim 2, wherein:

said positioning step positions said adjustable form system a predetermined distance of approximately four inches away from the existing pump island base.

11. The method according to claim 3, wherein:

said positioning step positions said adjustable form system a predetermined distance of approximately four inches away from the existing pump island base.

12. The method according to claim 4, wherein:

said positioning step positions said adjustable form system a predetermined distance of approximately four inches away from the existing pump island base.

13. The method according to claim 5, wherein:

said positioning step positions said adjustable form system a predetermined distance of approximately four inches away from the existing pump island base.

14. The method according to claim 6, wherein:

said positioning step positions said adjustable form system a predetermined distance of approximately four inches away from the existing pump island base.

15. The method according to claim 7, wherein:

said positioning step positions said adjustable form system a predetermined distance of approximately four inches away from the existing pump island base.

16. The method according to claim 8, wherein:

said positioning step positions said adjustable form system a predetermined distance of approximately four inches away from the existing pump island base.

17. A method of constructing a pump island protector to alleviate continuous maintenance required for a deteriorating existing steel pump island base and higher portions disposed on the base, comprising the steps of:

bending an existing steel perimeter form of the existing steel pump island base to a 90-degree angle for use as an anchoring point from the existing pump island base to new concrete and to create a clean edge;

forming a first cut in the perimeter of the existing island to a predetermined depth for accepting in said cut a stainless steel member to be dropped into said cut;

positioning an adjustable form system a predetermined distance away from the existing pump island base;

cutting and bending said stainless steel member to line the adjustable form system;

pouring ready mix concrete into the adjustable form system flush with the top surface of the existing pump island base and finishing the concrete;

removing the adjustable form system;

bending an existing steel perimeter form of at least one of the higher portions disposed on the base to a 90-degree angle for use as an anchoring point from the existing higher portion to new concrete and to create a clean edge;

forming a second cut in the perimeter of the existing higher portion to a predetermined depth for accepting in said second cut a second stainless steel member to be dropped into said second cut;

positioning a second adjustable form system a predetermined distance away from the existing higher portion;

cutting and bending said second stainless steel member to line said second adjustable form system;

pouring ready mix concrete into said second adjustable form system flush with the top surface of the existing higher portion and finishing the concrete; and removing said second adjustable form system to provide the completed pump island protector.

18. A pump island protector produced according to the method of claim 1.

19. A pump island protector produced according to the method of claim 8.

20. A pump island protector produced according to the method of claim 17.

* * * * *